US007179048B2

(12) United States Patent
Huang et al.

(10) Patent No.: US 7,179,048 B2
(45) Date of Patent: Feb. 20, 2007

(54) COOLING APPARATUS WITH A MESH STRUCTURE

(75) Inventors: Jin-Shu Huang, Miaoli County (TW); Shang-Hsuang Wu, Miaoli County (TW); Nien-Hui Hsu, Miaoli County (TW)

(73) Assignee: Coretronic Corporation, Miaoli County (TW)

( * ) Notice: Subject to any disclaimer, the term of this patent is extended or adjusted under 35 U.S.C. 154(b) by 127 days.

(21) Appl. No.: 11/019,176

(22) Filed: Dec. 23, 2004

(65) Prior Publication Data

US 2006/0093474 A1 May 4, 2006

(30) Foreign Application Priority Data

Oct. 28, 2004 (TW) ..... 93132801 A

(51) Int. Cl.
*F04D 29/46* (2006.01)

(52) U.S. Cl. ..... 415/126; 415/211.2; 415/212.1

(58) Field of Classification Search ..... 415/206, 415/211.2, 212.1, 213.1, 126
See application file for complete search history.

(56) References Cited

U.S. PATENT DOCUMENTS 4,538,362 A * 9/1985 Andis ..... 34/97
6,641,267 B2 * 11/2003 Ohishi et al. ..... 353/61

* cited by examiner

*Primary Examiner*—Ninh H. Nguyen
(74) *Attorney, Agent, or Firm*—Rosenberg, Klein & Lee

(57) ABSTRACT

A cooling apparatus with a mesh structure for cooling a lampwick of a projector. The cooling apparatus includes a blower, an adjustable air duct disposed at an outlet of the blower. The adjustable air duct further includes an air duct portion, a guiding portion, and a mesh structure. The blower blows cooling air to the air duct that is directly formed on the blower or installed on the blower with a separate air duct. The guiding portion is configured at an outlet of the air duct. The mesh structure couples to the guiding portion to move a lower portion of the guiding portion by gravity so that most part of the cooling air is blown to the lampwick through an upper portion of the guiding portion.

8 Claims, 3 Drawing Sheets

COOLING APPARATUS WITH A MESH STRUCTURE

RELATED APPLICATIONS

The present application is based on, and claims priority from, Taiwan Application Serial Number 93132801, filed Oct. 28, 2004, the disclosure of which is hereby incorporated by reference herein in its entirety.

BACKGROUND OF THE INVENTION

1. Field of Invention

The invention relates to a cooling apparatus and, in particular, to a cooling apparatus with a mesh structure.

2. Description of Related Art

Since hot air rises, the temperature on the upper surface of a projector lampwick is greater than that on its lower surface. Thus, the cooling apparatus of the lampwick has to be designed according to different temperatures on its upper and lower surfaces. For example, the temperature of the upper surface is controlled not to exceed 100° C. while that on the lower surface not to go below 880° C. Thus, the temperature difference between the upper and lower surfaces of the lampwick is better to be controlled within 120° C. However, the temperature difference is not easy to control. If they are cooled under the same cooling conditions, it is very hard to satisfy the desired temperature requirements. This will directly affect the performance and lifetime of the lampwick. Moreover, some projectors are not only designed to be used on planar tables, but also hung on the ceiling at places of limited space. If one adopts the design that the outlet of the cooling apparatus faces the upper surface of the lampwick in its planar position, the temperature drop on the lower surface of the lampwick will be greater than that on the upper surface when the projector is hung up side down. This affects the performance and the lifetime of the lampwick.

SUMMARY OF THE INVENTION

Therefore, an objective of the invention is to provide a cooling apparatus with a mesh structure to provide the upper and lower surfaces of a lampwick with different cooling conditions so as to satisfy different requirements.

Another objective of the invention is to provide a cooling apparatus with a mesh structure so that the temperature difference between the upper and lower surfaces of a lampwick when the projector is hung up side down is that same as when it is disposed on a plane.

To achieve the above objective, the disclosed cooling device with a mesh structure contains a blower and an adjustable air duct, which is disposed at an outlet of the blower. The adjustable air duct contains an air duct portion, a guiding portion, and a mesh structure. The blower sends cooling air to the air duct portion and, through the guidance of which, to the lampwick inside a lampshade. The air duct portion contains a square outlet. The air duct portion can be directly formed on or coupled to the blower. The outlet of the air duct portion faces the inside of the lampshade. The guiding portion is configured at the outlet. The size of the mesh structure is about 30%~70% of the outlet area. The mesh structure is coupled to the guiding portion in an adjustable way and slides along the guiding portion. The mesh structure couples to the guiding portion to move a lower portion of the guiding portion by gravity so that most part of the cooling air is blown to the lampwick through an upper portion of the guiding portion.

When the projector is in a planar position, most of the cooling air is blown to the upper surface of the lampwick through the upper portion of the guiding portion. Less cooling air is flown to the lower surface of the lampwick due to the blocking of the mesh structure in the lower portion of the guiding portion. Therefore, the upper and lower surfaces of the lampwick are under different cooling conditions in order to satisfy different requirements.

When the projector is hung up side down, the mesh structure falls to the lower portion of the outlet due to the force of gravity. Therefore, the temperature difference between the upper and lower surfaces of the lampwick still remains the same as the planar configuration.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE PREFERRED EMBODIMENT

The present invention will be apparent from the following detailed description, which proceeds with reference to the accompanying drawings, wherein the same references relate to the same elements.

Figure 1:
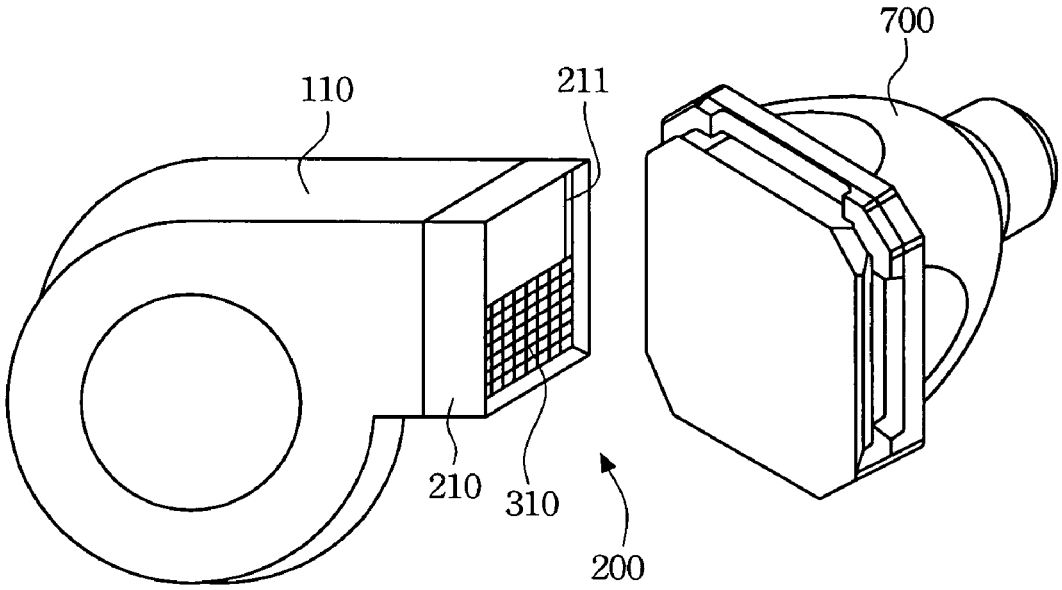
FIG. 1 is a three-dimensional schematic view of a cooling apparatus with a mesh structure in its planar position according to a preferred embodiment of the invention.

As shown in FIG. 1, the cooling apparatus with a mesh structure according to the invention contains a blower 110 and an adjustable air duct 200, which is configured at an outlet of the blower 110. The adjustable air duct 200 further contains an air duct portion 210, a guiding portion 211, and a mesh structure 310. The blower 110 includes a centrifugal fan to send cooling air to the air duct 210 portion and, through the guidance of which, to the lampwick 500 inside the lampshade 700. The air duct portion 210 contains a square outlet. The air duct portion 210 can be directly formed on or coupled to the blower 110. The outlet of the air duct portion 210 directs to the lampshade 700. The guiding portion is configured at the outlet of the air duct portion 210. The mesh structure 310 has an opening rate between 0% and 90%. It is coupled to the guiding portion in an adjustable way and slides along the guiding portion 211. Due to the force of gravity, the mesh structure 310 falls to a lower portion of the air duct portion 210, forming a block. As a result, most of the cooling air is blown to an upper portion of the outlet of the air duct portion 210. The upper surface of the lampwick 500 receives more cooling air. Less cooling air is blown to the lower surface of the lampwick 500 because of the blocking of the mesh structure 310. Therefore, the upper and lower surfaces of the lampwick 500 are under different cooling conditions in order to satisfy different requirements.

Figure 2A:
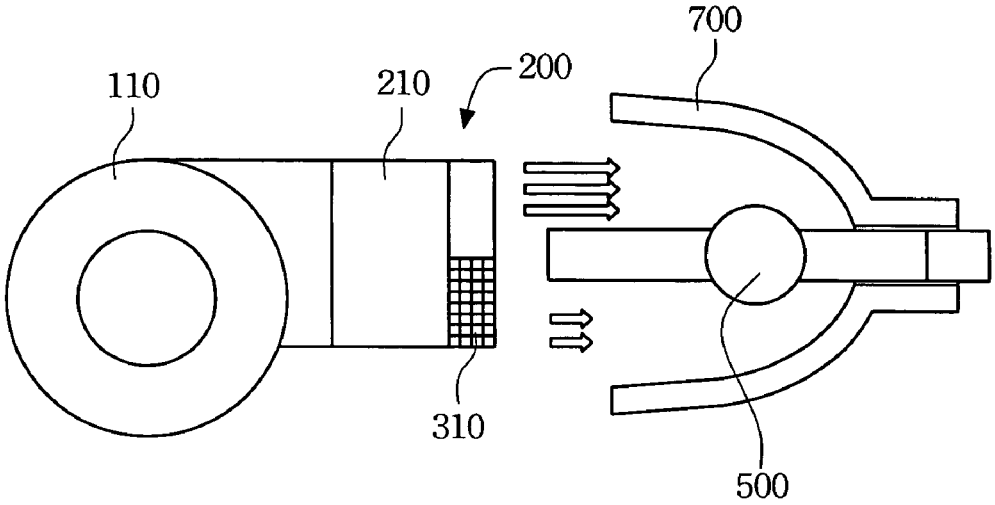
FIG. 2A is a schematic side cross-sectional view of FIG. 1.
Figure 2B:
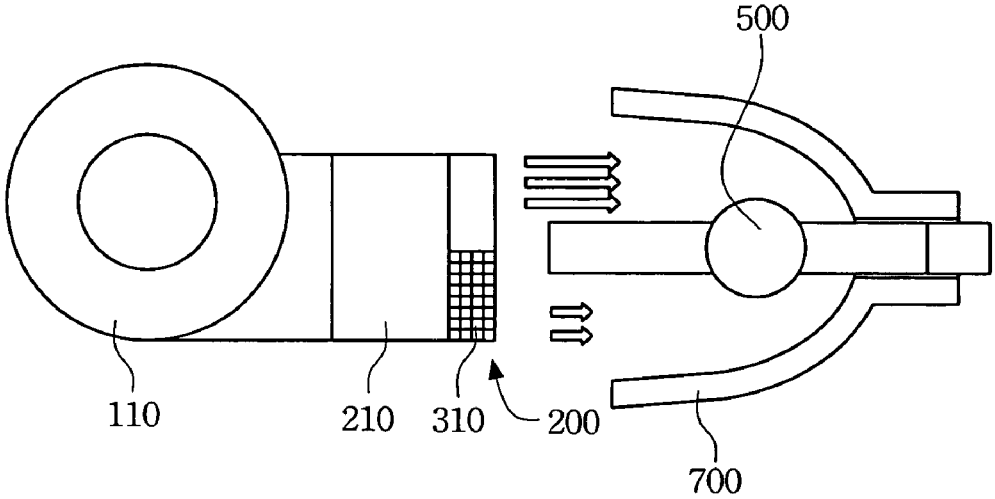
FIG. 2B is a schematic side cross-sectional view of the cooling apparatus in FIG. 1 hanging up side down.

As shown in FIG. 2A, when the disclosed cooling apparatus with a mesh structure is used in its planar position, the mesh structure 310 falls to a lower portion of the outlet due to the force of gravity. The mesh structure 310 also allows air to pass through. More air is blown through the upper portion than the lower portion of the outlet. Therefore, the upper surface of the lampwick 500 receives more cooling air via the upper portion of the outlet, while the lower surface of the lampwick 500 receives less cooling air because of the blocking of the mesh structure 310. The upper and lower surfaces of the lampwick 500 are under different cooling conditions in order to satisfy different requirements. As shown in FIG. 2B, when the projector is hung up side down, the mesh structure falls due to the force of gravity down to the lower portion of the outlet of the air duct potion 210 in the overhanging position. Consequently, the temperature difference between the upper and lower surfaces of the lampwick 500 still remains the same as in the planar position.

Figure 3A:
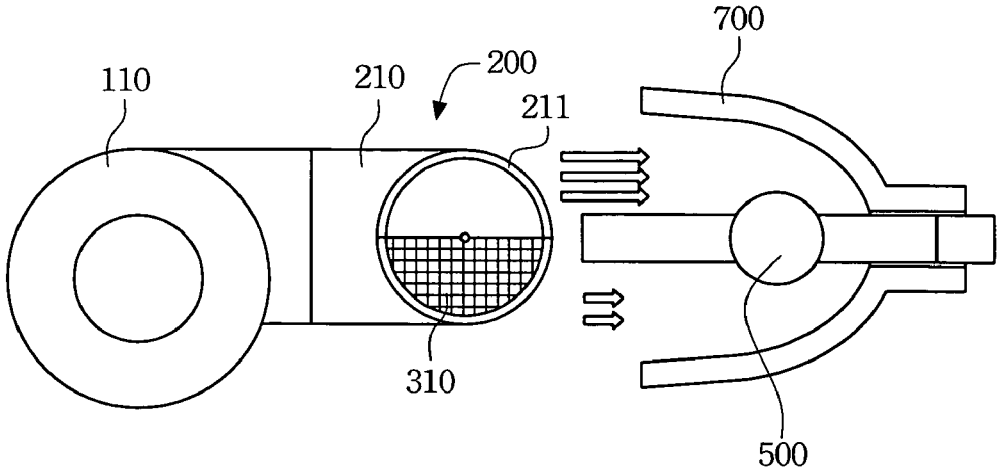
FIG. 3A is a schematic side cross-sectional view of another embodiment.
Figure 3B:
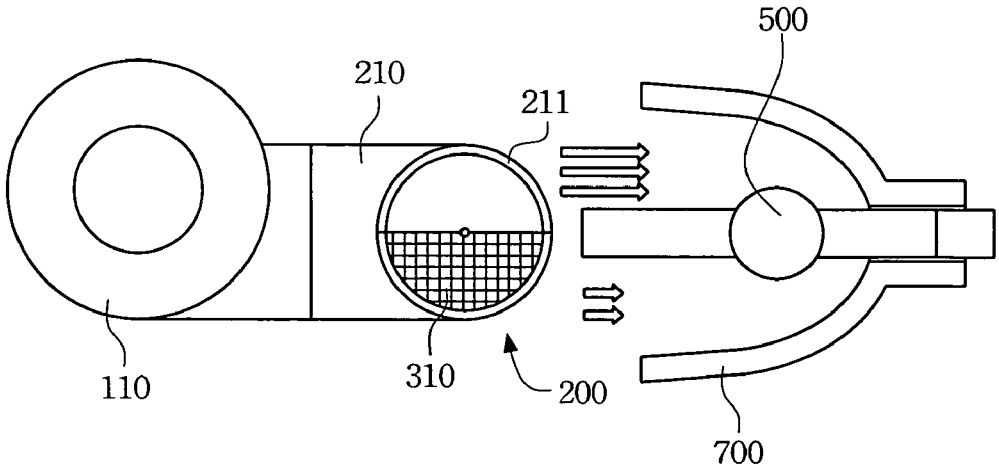
FIG. 3B is a schematic side cross-sectional view of the cooling apparatus in FIG. 3A hanging up side down.

Various kinds of modifications can be made within the scope of the invention. For example, the shape of the openings on the mesh structure 310 can be square, as in FIG. 1, circular, or hexagonal. The installation direction of the blower 110 is not limited to the one shown in the drawing. It can be installed in any orientation as long as it can generate a pressure to send cooling air into the air duct portion 210. The shape of the air duct portion 210 is also not limited to the straight tube as shown in the drawing. One can freely design the shape of the air duct portion according to the needs. The outlet of the air duct portion 210 can be configured to be close to the lampshade 700. An auxiliary air duct portion (not shown in the drawing) can be provided between the outlet of the air duct portion 210 and the lampshade 700 to guide the cooling air into the lampshade 700. The shape of the outlet is not limited to square either. As shown in FIGS. 3A and 3B, the air duct portion 210 contains a circular outlet. The same effect can be achieved by using a fan mesh structure as the mesh structure 310. The fan mesh structure 310 is coupled to the guiding portion in an adjustable way and slides along the guiding portion with the center of the outlet as a rotational axis.

Therefore, one sees from the above-mentioned preferred embodiment that the invention has the following advantages:

1. The disclosed cooling apparatus with a mesh structure allows most of the cooling air to pass through an upper portion of the outlet of an air duct portion to cool the upper surface of the lampwick. The lower portion of the outlet is blocked by a mesh structure to allow less cooling air to flow through to cool the lower surface of the lampwick. The upper and lower surfaces of the lampwick are thus under different cooling conditions. This can maintain the performance of the lampwick and elongate its lifetime.

2. When a projector using the disclosed cooling apparatus with a mesh structure is hung up side down, the temperature different between the upper and lower surfaces of the lampwick can still remain the same as the planar position.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A cooling apparatus with a mesh structure for cooling a lampwick inside a lampshade of a projector, comprising:
- a blower; and
- an adjustable air duct, disposed at an outlet of the blower, the adjustable air duct comprising:
  - an air duct portion for guiding cooling air, wherein an outlet of the air duct portion directs toward the lampshade;
  - a guiding portion configured at an outlet of the air duct portion; and
  - a mesh structure coupled to the guiding portion and sliding along the guiding portion.

2. The cooling apparatus with a mesh structure of claim 1, wherein the air duct portion is directly formed on the blower.

3. The cooling apparatus with a mesh structure of claim 1, wherein the air duct portion is coupled to the blower after it is formed independently.

4. The cooling apparatus with a mesh structure of claim 1, wherein the air duct portion has a square outlet.

5. The cooling apparatus with a mesh structure of claim 1, wherein the air duct portion has a circular outlet.

6. The cooling apparatus with a mesh structure of claim 1, wherein the mesh structure has an opening rate between 0% and 90%.

7. The cooling, apparatus with a mesh structure of claim 1, wherein the mesh structure slides along the guiding portion due to the force of gravity.

8. The cooling apparatus with a mesh structure of claim 1, wherein the air duct portion further comprises an auxiliary air duct portion configured between the outlet and the lampshade to guide cooling air into the lampshade.

* * * * *